US012326050B2

(12) United States Patent
Hern et al.

(10) Patent No.: US 12,326,050 B2
(45) Date of Patent: Jun. 10, 2025

(54) GUIDE ASSEMBLY, METHOD AND SYSTEM

(71) Applicant: Baker Hughes Oilfield Operations LLC, Houston, TX (US)

(72) Inventors: Christopher Hern, Porter, TX (US); Marc Samuelson, Houston, TX (US); Shane Harris, Cypress, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 293 days.

(21) Appl. No.: 17/890,390

(22) Filed: Aug. 18, 2022

(65) Prior Publication Data

US 2023/0105819 A1 Apr. 6, 2023

Related U.S. Application Data

(60) Provisional application No. 63/248,722, filed on Sep. 27, 2021.

(51) Int. Cl.

| | |
|---|---|
| ***E21B 23/00*** | (2006.01) |
| ***E21B 17/14*** | (2006.01) |
| ***E21B 19/24*** | (2006.01) |

(52) U.S. Cl.

CPC ..... *E21B 23/00* (2013.01); *E21B 17/14* (2013.01); *E21B 19/24* (2013.01)

(58) Field of Classification Search

CPC ..... E21B 23/00; E21B 17/14; E21B 19/24

See application file for complete search history.

(56) References Cited

U.S. PATENT DOCUMENTS

| | | | | |
|---|---|---|---|---|
| 3,266,577 A * | 8/1966 | Turner | E21B 17/14 166/222 |
| 4,321,965 A | 3/1982 | Restarick et al. | |
| 5,669,443 A * | 9/1997 | Budde | E21B 17/14 166/242.6 |
| 5,947,214 A * | 9/1999 | Tibbitts | E21B 17/076 175/292 |

(Continued)

FOREIGN PATENT DOCUMENTS

| | | |
|---|---|---|
| CN | 112955628 A | 6/2021 |
| EP | 3020911 A1 | 5/2016 |

(Continued)

OTHER PUBLICATIONS

Notification of Transmittal of the International Search Report and Written Opinion; PCT/US2022/076783; Korean Intellectual Property Office; Mailed Sep. 21, 2022; 10 pages.

*Primary Examiner* — D. Andrews

(74) *Attorney, Agent, or Firm* — Baker Hughes Patent Organization

(57) ABSTRACT

A guide assembly including a guide nose, a body supporting the guide nose, and a torque limiter having a configuration to connect the guide nose and the body to a separate structure. A method for negotiating a restriction in a borehole including running a guide assembly into the borehole, encountering a restriction with the guide nose, limiting torque on the guide nose while encountering the restriction, longitudinally unloading the guide nose, incrementing an incrementing feature of the guide assembly to thereby rotate the guide nose. A wellbore system including a borehole in a subsurface formation, a string in the borehole, a guide assembly disposed within or as a part of the string.

17 Claims, 23 Drawing Sheets

(56) References Cited

U.S. PATENT DOCUMENTS

| | | | | |
|---|---|---|---|---|
| 7,681,637 | B2 * | 3/2010 | Frazier | E21B 17/14 166/117.7 |
| 8,555,765 | B2 * | 10/2013 | Graham, II | F41A 21/325 89/14.3 |
| 11,203,902 | B2 * | 12/2021 | MacKay | E21B 17/14 |
| 11,598,169 | B2 * | 3/2023 | Patterson | E21B 23/12 |

FOREIGN PATENT DOCUMENTS

| | | | |
|---|---|---|---|
| WO | 2011014565 | A2 | 2/2011 |
| WO | 2018156029 | A2 | 8/2018 |

* cited by examiner

GUIDE ASSEMBLY, METHOD AND SYSTEM

CROSS REFERENCE TO RELATED APPLICATIONS

This application claims the benefit of an earlier filing date from U.S. Provisional Application Ser. No. 63/248,722 filed Sep. 27, 2021, the entire disclosure of which is incorporated herein by reference.

BACKGROUND

In the resource recovery and fluid sequestration industries, it is often necessary to run a string into another tubular structure that may include restrictions such as profiles or reductions in inside diameter of the tubular structure. Guide noses have been used on strings for some time to help with this issue. Guide noses may be bull noses or cones or may have an asymmetric constitution whereby a ramped portion of the guide nose is created. In connection with the latter, the guide nose can sometimes become engaged with a profile or similar especially when large upward facing profiles on the engaged equipment are the first thing to be encountered. In these situations where a guide nose engages a profile while attempting to centralize the stabbing equipment, the guide nose can become shouldered or trapped in a gap. The art would well receive alternative constructions that would enable passage of complex profiles while reducing likely hood of damage or failure.

SUMMARY

An embodiment of a guide assembly including a guide nose, a body supporting the guide nose, and a torque limiter having a configuration to connect the guide nose and the body to a separate structure.

An embodiment of a method for negotiating a restriction in a borehole including running a guide assembly into the borehole, encountering a restriction with the guide nose, limiting torque on the guide nose while encountering the restriction, longitudinally unloading the guide nose, incrementing an incrementing feature of the guide assembly to thereby rotate the guide nose.

An embodiment of a wellbore system including a borehole in a subsurface formation, a string in the borehole, a guide assembly disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
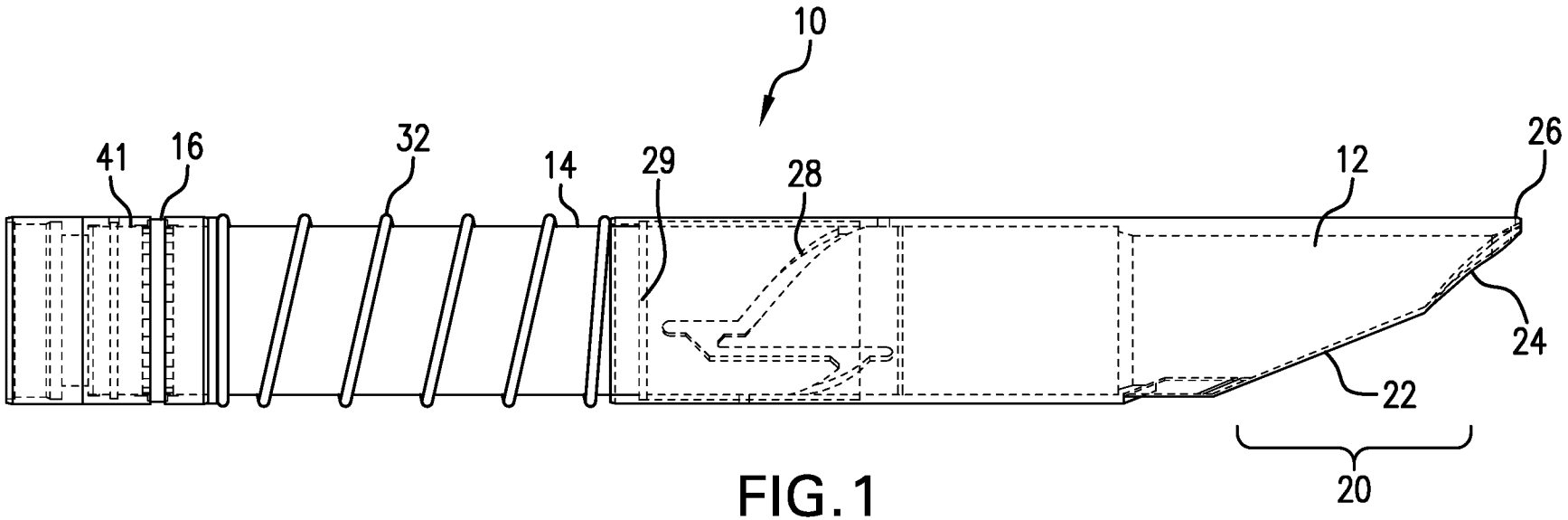
FIG. 1 is a view of a guide assembly as disclosure herein.
Figure 2:
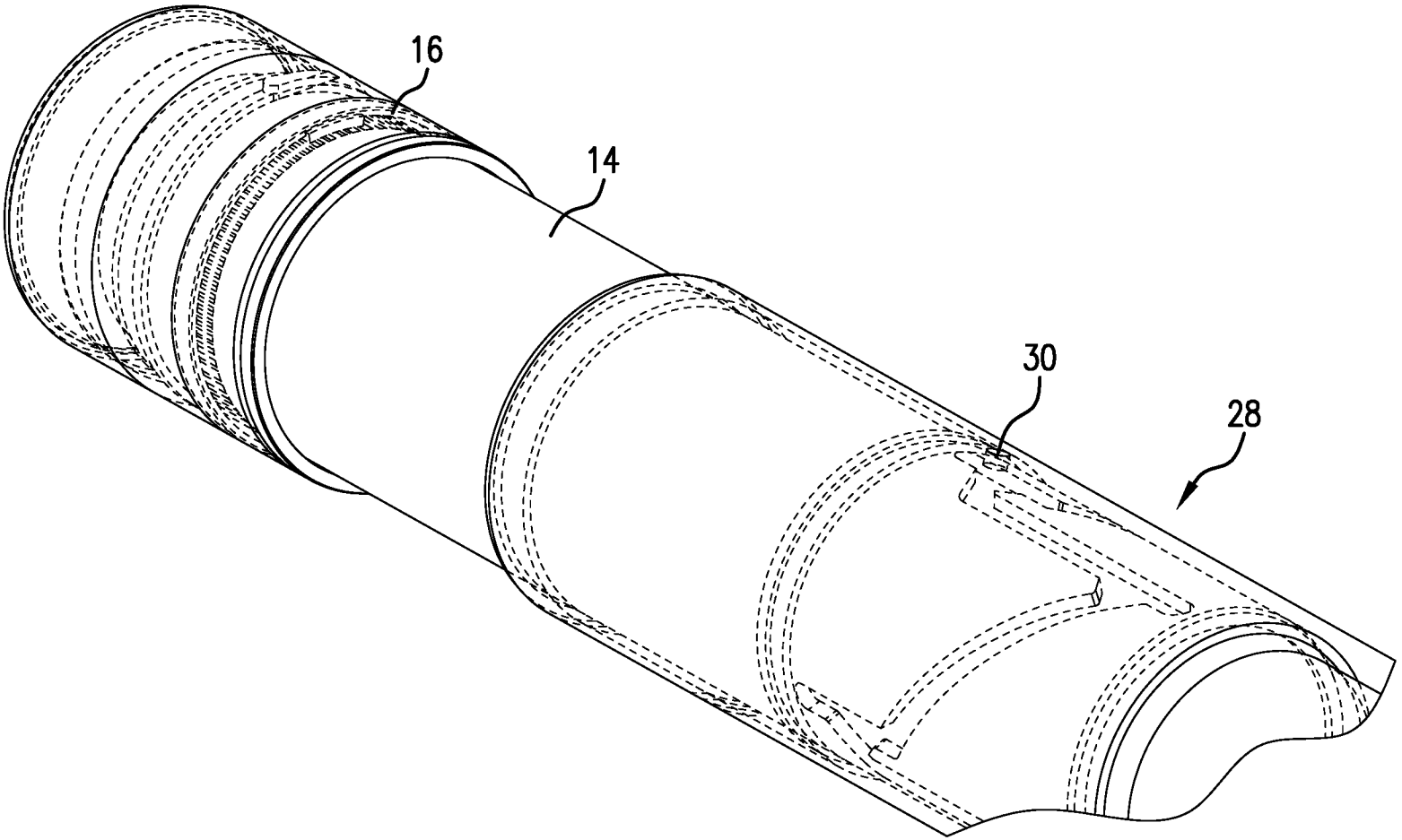
FIG. 2 is an enlarged perspective view of a portion of the assembly of FIG. 1.
Figure 3:
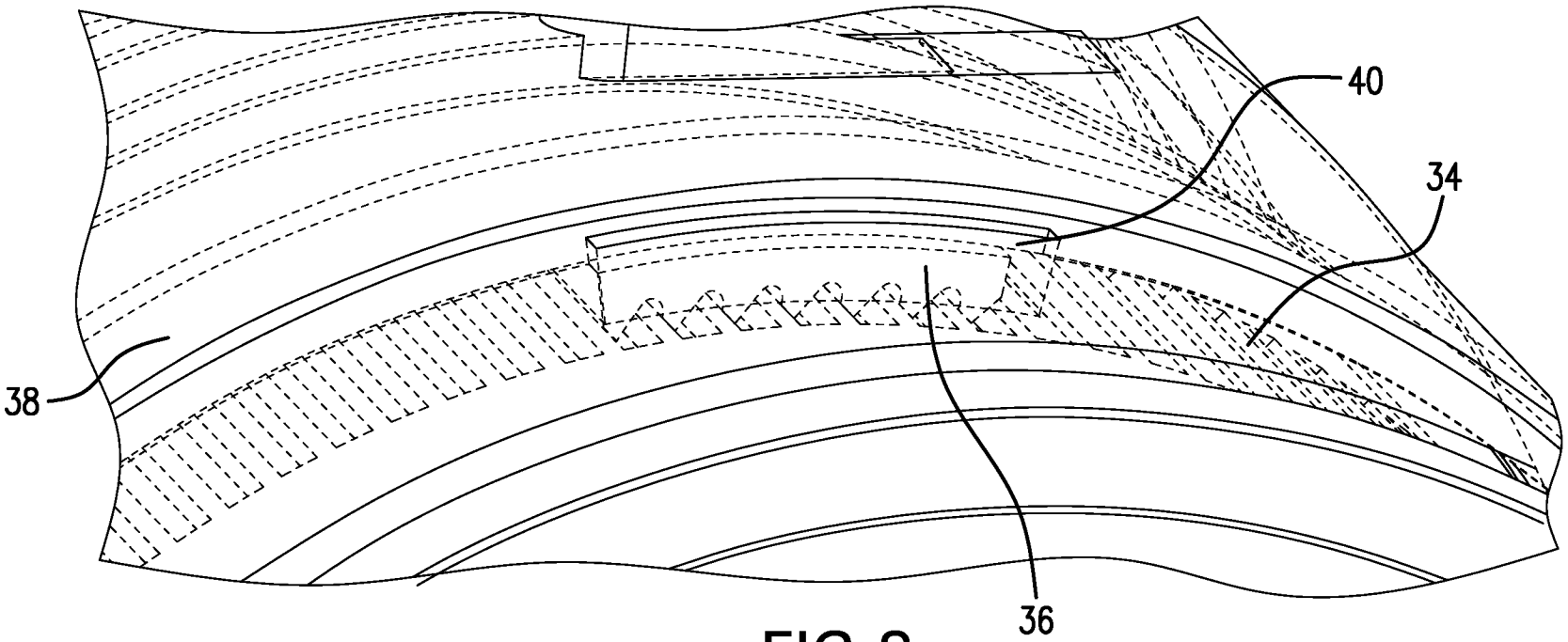
FIG. 3 is a further enlarged perspective view of a portion of FIG. 2.
Figure 4:
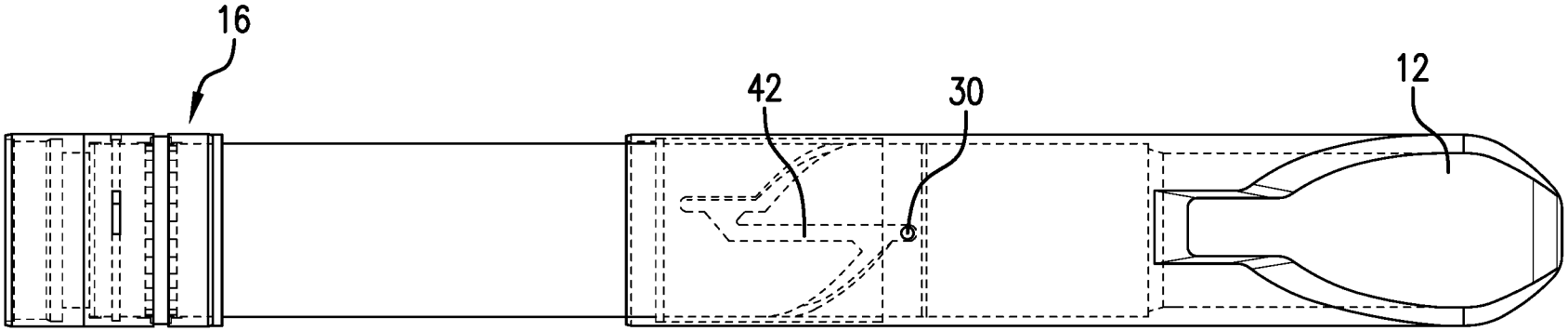
FIGS. 4-9 are a series of views illustrating sequential positions of the guide assembly during use.
Figure 5:
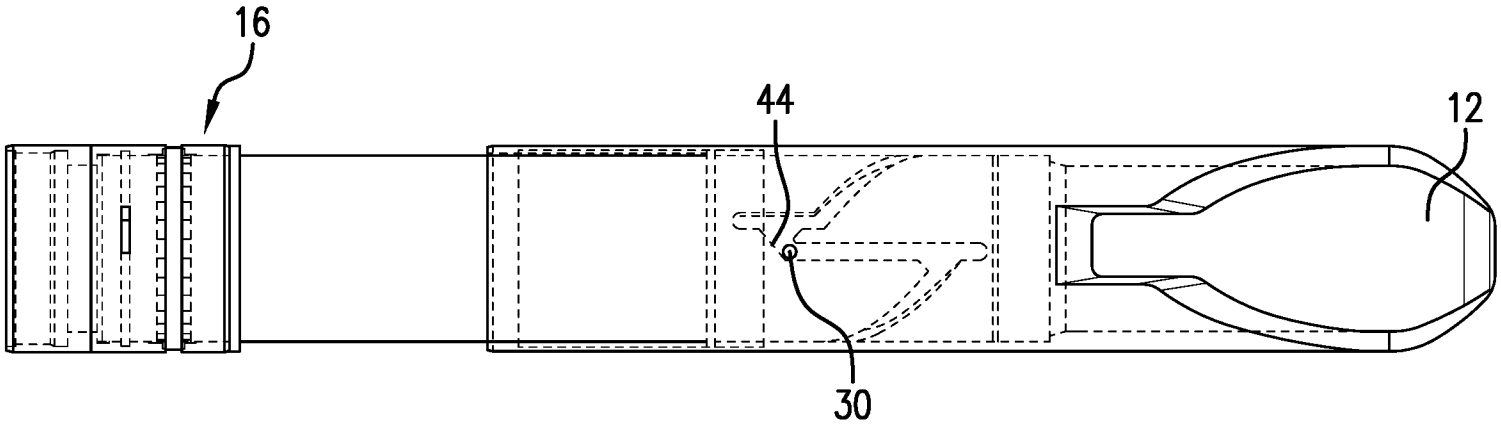
Figure 6:
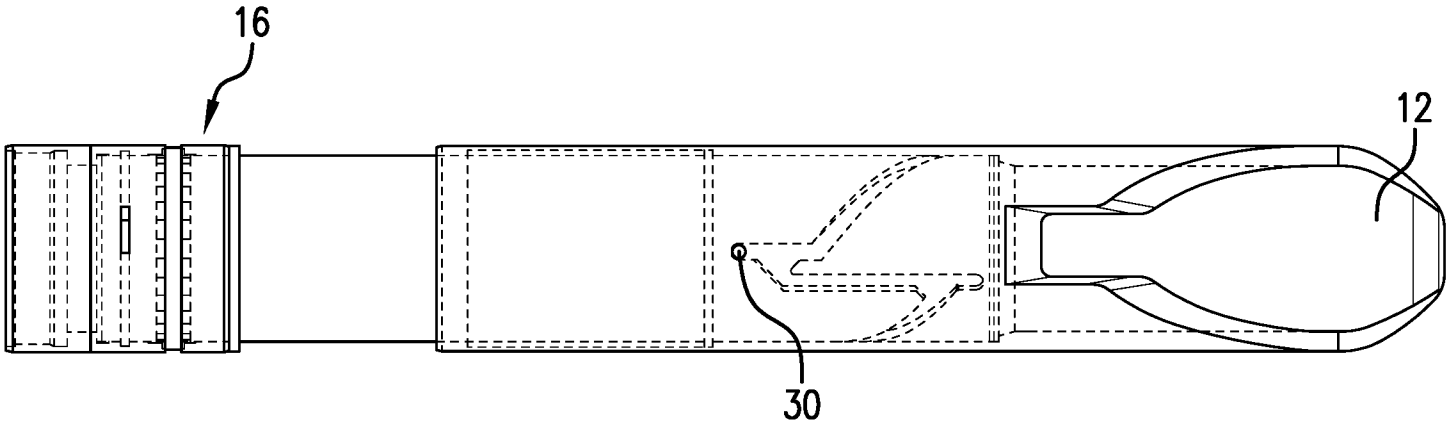
Figure 7:
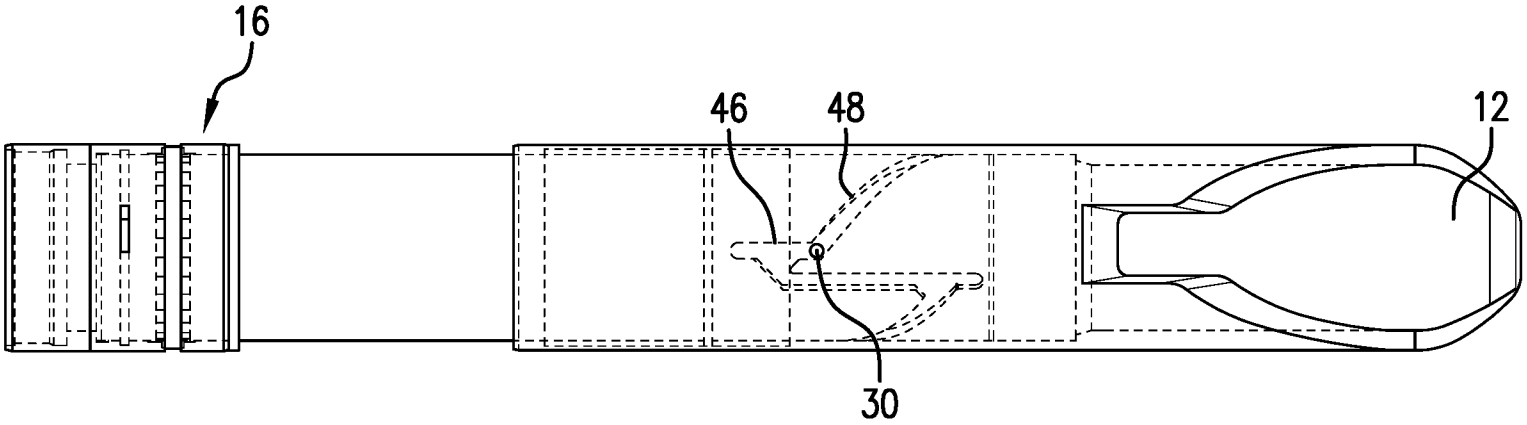

Referring to FIG. 1, a guide assembly 10 is illustrated. The assembly 10 includes a guide nose 12, a body 14 and a torque limiter 16. It should be understood that although not shown specifically in FIG. 1 but schematically illustrated in FIG. 13, the torque limiter 16 end of the assembly 10 will be connected to a string 116 to be run in the hole during use. The guide nose 12 in an embodiment may be configured asymmetrically when considered on a longitudinal cross section. In the embodiment illustrated this is substantially in the shape of a tubular member cut off on an angle relative to a longitudinal axis of the tubular member. In the illustrated embodiment, there is an angled portion 20 that comprises two angled segments 22 and 24 (which may be a helical angle in some embodiments). There is also a transition point 26 where the angled position 20 transitions to either a surface that is orthogonal to a guide nose longitudinal axis or angled in a direction other than the general direction of the angled portion 20. Specifically, this means that the angled portion 20 may transition to a flat or may transition to another angled surface going in the other direction from the first. In either case, the important feature is the transition since it is this feature that must pass an impediment in order to prevent back rotation of the guide assembly 10 during use. This will become clearer as the inventive concept is described. The assembly 10 includes an incrementing feature 28 such as a J-slot. The guide nose 12 is mounted to the body 14 such that it may telescopically ride on body 14. The guide nose 12 may include a pin 30 as illustrated, with the J-slot 28 on the body 14 or the guide nose 12 may include the J-slot 28 while the pin 30 is on the body 14 (not shown but easy to understand as it simply reverses the position of the operative parts and works the same way). With the illustrated configuration, the guide nose 12 is longitudinally moveable relative to the body 14 and therefore longitudinally moveable relative to the incrementing feature 28. The pin 30, see FIGS. 4-9, disposed on the guide nose 12, will, with such longitudinal movement, cause the guide nose 12 to rotate relative to body 14. In an embodiment, each increment is about 110 degrees (though more or fewer might be selected for specific applications). Optionally, a biaser 32 is disposed between the guide nose 12 and the torque limiter 16 to help cycle the incrementing feature 28. In an embodiment, the biaser 32 is a coil spring. Also in an embodiment, a retention wire 29 is added to secure guide nose 12 to the body 14

Attached to the body 14 is the torque limiter 16. This allows the passage of compressive and tensile loads to the body 14 but does so only to a design point with regard to the torque that is to be transmitted versus a torque greater than that desired. In the illustrated embodiment, the limiter 16 comprises a ratchet 34 and pawl 36 configuration. The pawl 36 is urged into engagement with the ratchet 34 by a biasing member 38 and when so engaged will transmit torque across the torque limiter 16 but when the biasing member 38 inward bias is overcome by outward bias of the pawl 36 due to the amount of torque being transmitted through the pawl 36 and ratchet 34, the pawl 36 is forced radially outwardly out of engagement with ratchet 34 thereby interrupting the transmission of torque therethrough. Limitation is directly related to the amount of biasing force applied to the pawl 36 by the biasing member 38. In an embodiment, the biasing member 38 is a C-ring. In order to ensure the pawl 36 is reliable, it is captured by a recess 40 of a ratchet housing 41 in an embodiment, leaving only enough movement potential for the pawl 36 to move radially outwardly enough to disengage the rachet 34. While the pawl and ratchet type of torque limiter 16 have been illustrated, it is to be appreciated that other torque limiting configurations might be substituted including but not limited to: Ball detent-type torque limiters, clutch-type or friction plate-type torque limiters, magnetic torque limiters, etc. It is also contemplated, in an embodiment, to have the ratchet 34 and pawl 36 be configured for ratcheting for torque limitation in one direction while locking in the opposite direction, for some embodiments. The torque limiter 16 also comprises a configuration to connect the guide nose and the body to a separate structure, that structure being, for example, the string 116 and the configuration for example being a pin or box thread.

During use, the assembly 10 is run into a borehole and the guide nose 12 bumps into something like a profile, restriction, etc. Sometimes the guide nose 12 can become engaged to an extent with the profile such that loaded torque through the guide nose 12 would damage the guide nose 12 or damage the profile with which the guide nose 12 has become engaged. The disclosed assembly 10 alleviates the over torque problem by the disposition of the torque limiter 16, which functions as described and limits torque that otherwise is transmitted to the nose 12 from a string to surface to a maximum permitted torque that is below a torque anticipated to be associated with damage to any of the components. At this point, picking up on the string and hence the assembly 10 slightly will result in body 14 pulling on incrementing feature 28 in the uphole direction and causing the pin 30 to follow the incrementing feature 28. It is to be appreciated that the incrementing feature 28 is configured such that a rotary input to the guide nose 12 is initiated only under the pulling up condition. This way, there is very little torsional load through the guide nose 12 on the restriction upon which it is stuck or engaged. The incrementing feature will rotate the guide nose 12 through a number of degrees that is dictated by the incrementing feature but in one embodiment and as illustrated is about 110 degrees. Other numbers of degrees are certainly contemplated. Upon completion of rotation, the assembly is again moved in the downhole direction where hopefully the guide nose will now slide past the restriction. If it does not slide past the restriction, the pulling back operation is repeated thereby making the guide nose rotate again by the same number of degrees. Subsequent repeats of the sequence may be continued until the guide nose does pass through the restriction.

Figure 8:
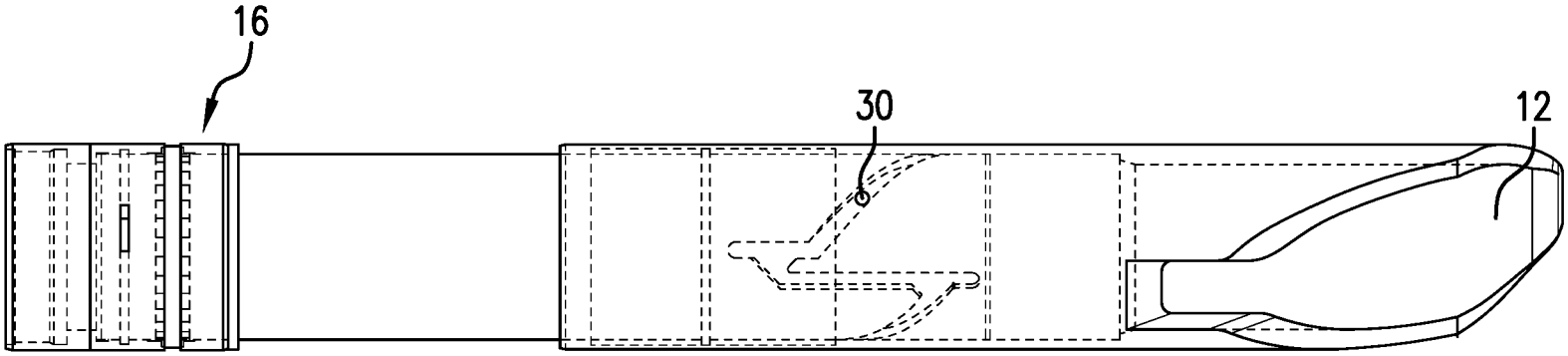
Figure 9:
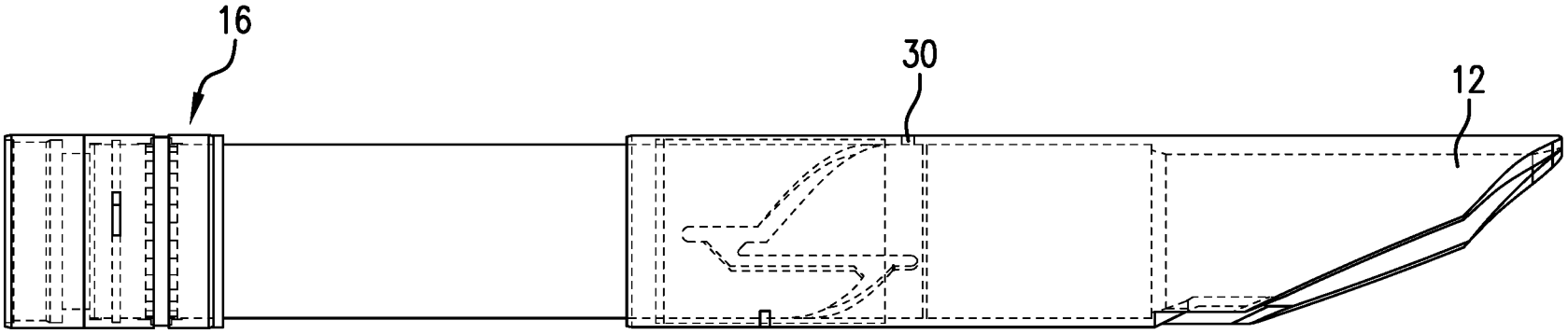

For a greater understanding of the cycling of the assembly just discussed, reference is made to FIGS. 4-9, which illustrate the assembly 10 in sequential positions based upon pulling up of the body 14. Between FIGS. 4 and 5, and following pin 30, one will appreciate that the assembly 10 is extended in FIG. 4 and compressed in FIG. 5. The pin 30 has moved in a portion 42 of the incrementing feature 28 that is parallel to a longitudinal axis of the assembly 10 and hence no rotational input is created. Continued compression of the assembly 10 does move the pin 30 through a portion 44 that provides only a small rotational input. Any potential torsional load that may be generated by this portion of compression will be relieved by the torque limiter 16. This input is more related to setting the incrementing feature for a larger rotational input upon the next pulling movement of the assembly 10, which is illustrated between FIGS. 6-8. When the assembly experiences a pick up from the surface, initially a nonrotational portion 46 is encountered by pin 30 but then a large rotational displacement portion 48 is encountered by pin 30. This portion 48 provides in the illustrated embodiment about 110 degrees of rotation of the guide nose 12 upon pick up. As noted above other numbers of degrees of rotation are contemplated and will be appreciated by those of ordinary skill. FIGS. 8 and 9 illustrate the effect of cycling on the guide nose 12.

Figure 10:
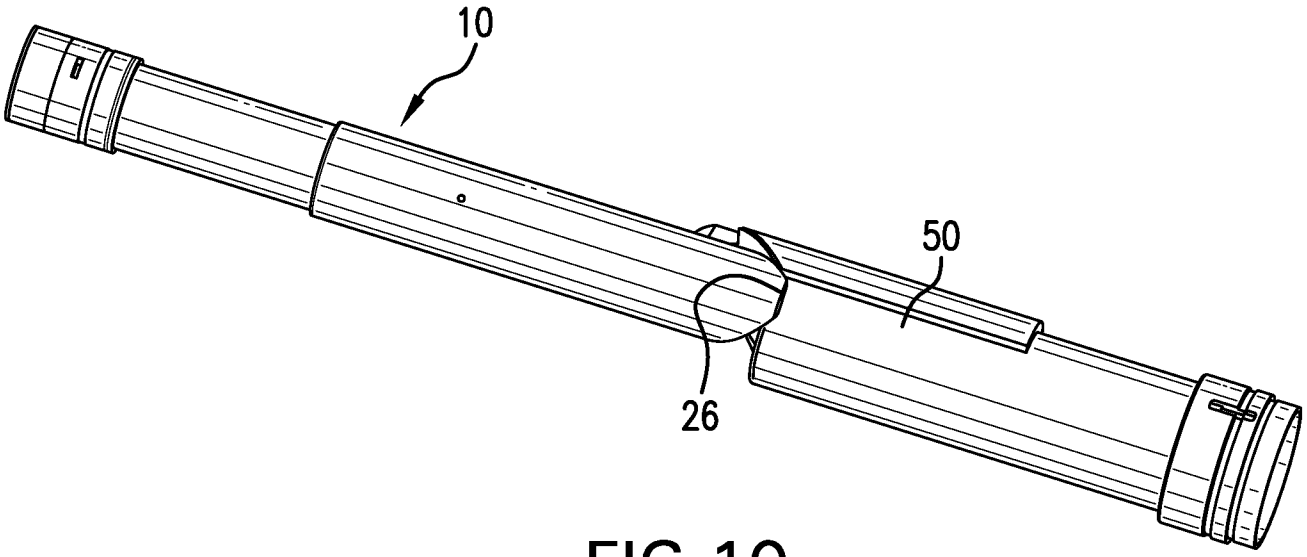
FIGS. 10-12 illustrate sequential positions of the assembly at a restriction.
Figure 11:
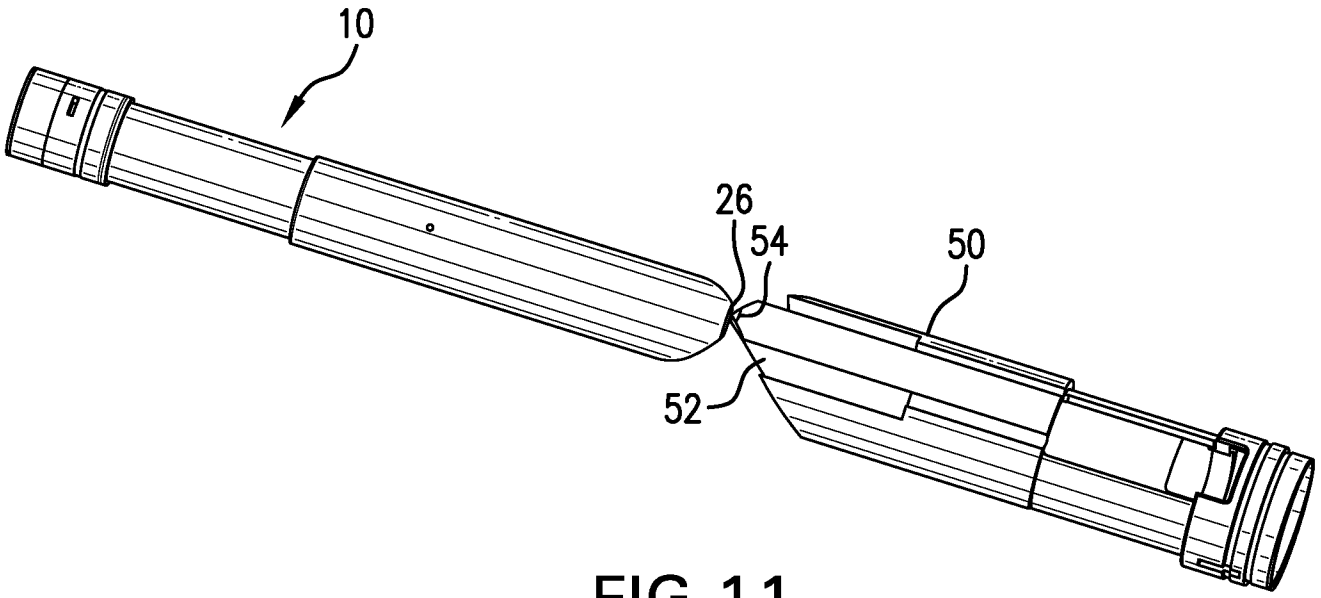
Figure 12:
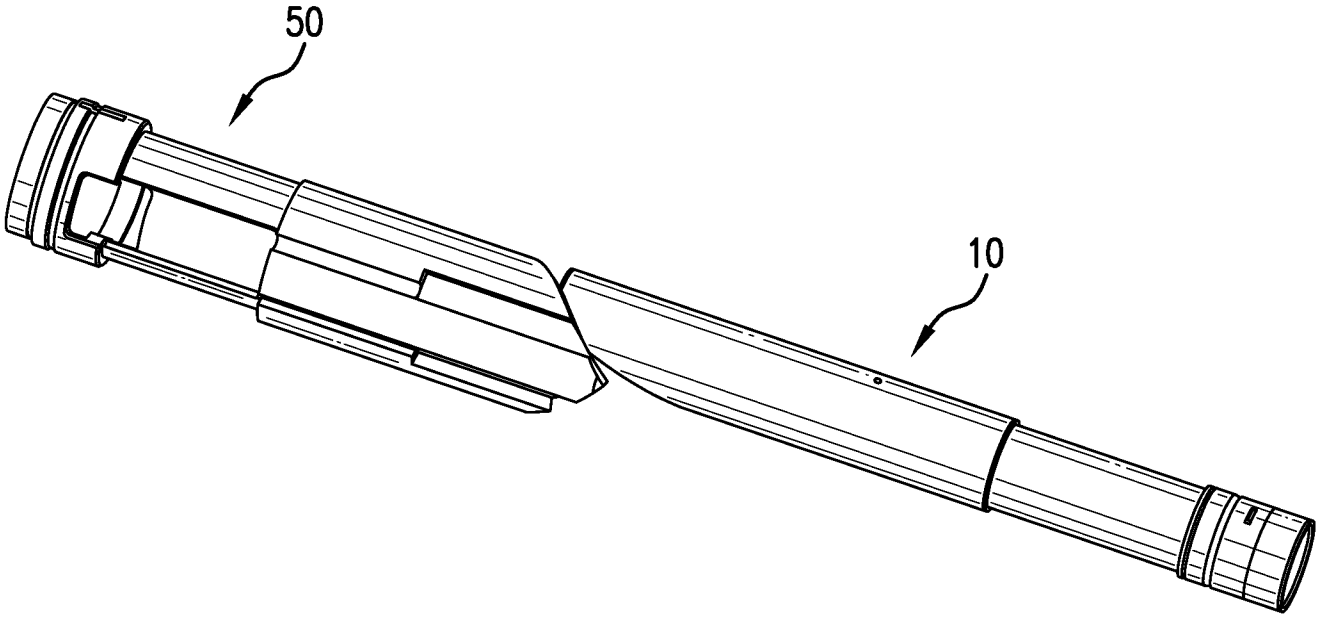

Referring to FIGS. 10-12, The selection of number of degrees of rotation is made clearer. A restriction 50 (the same restriction referred to above but not yet numbered at that time) presents an issue for the guide nose 12. The nose 12 has butted against the restriction 50. Rather than just torque the string and assembly 10, which often could result in damage to the assembly 10 or the restriction 50 or both, the configuration of the assembly 10 allows torque to be limited and then the guide nose 12 to be repositioned as has been described above. Importantly, the number of degrees of rotation needs to be enough to move the transition point 26 past any ramped part of the restriction 50 that could otherwise cause the assembly to rotate backwards and hence make no progress on cycling. In FIG. 10, one can see that a small degree of rotation that does not cause the transition point to move beyond the ramped portion 52 of restriction 50 will allow the guide nose to be urged to rotate backwards on compression pursuant to the torque limiter 16. Alternating compression and pick up that is the cycling of assembly 10 then will result in no rotational advancement of guide nose 12 and hence the guide nose 12 remains essentially stuck at the restriction. With appropriate number of degrees of rotation however, the assembly 10 will move through a sufficient number of degrees of rotation to cause transition point 16 to clear the ramped portion 52 and hence the guide nose 12 will not be driven backwards on further compression. The guide nose will either need another cycle and rotation to get beyond the point 54 of the restriction 50 or simply slide past depending upon position but regardless, this results in a new position of the assembly 10 and improves the likelihood of entering the restriction 50.

Figure 13:
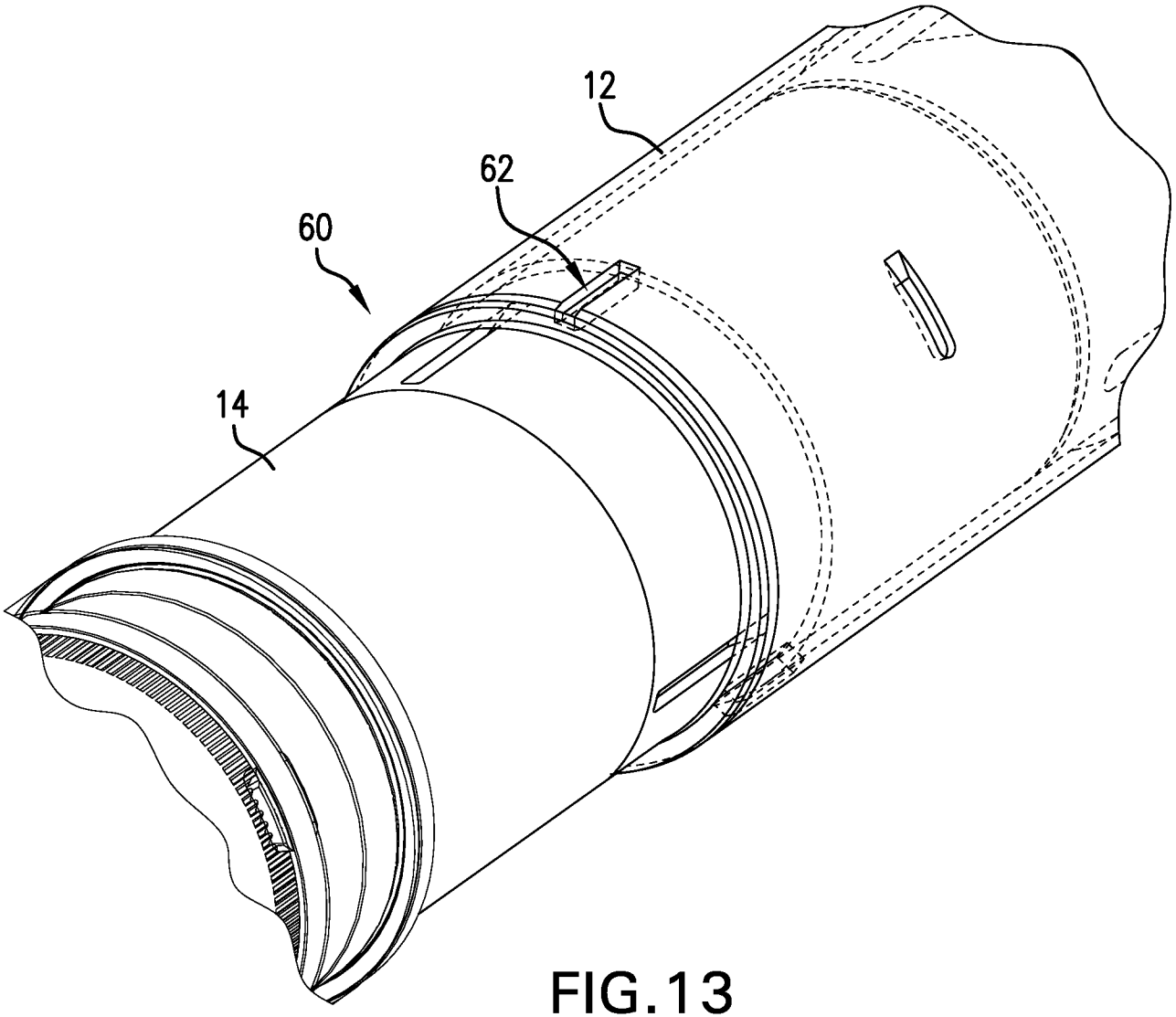
FIG. 13-15 are similar views of the assembly with an anti back rotation feature in different positions.
Figure 14:
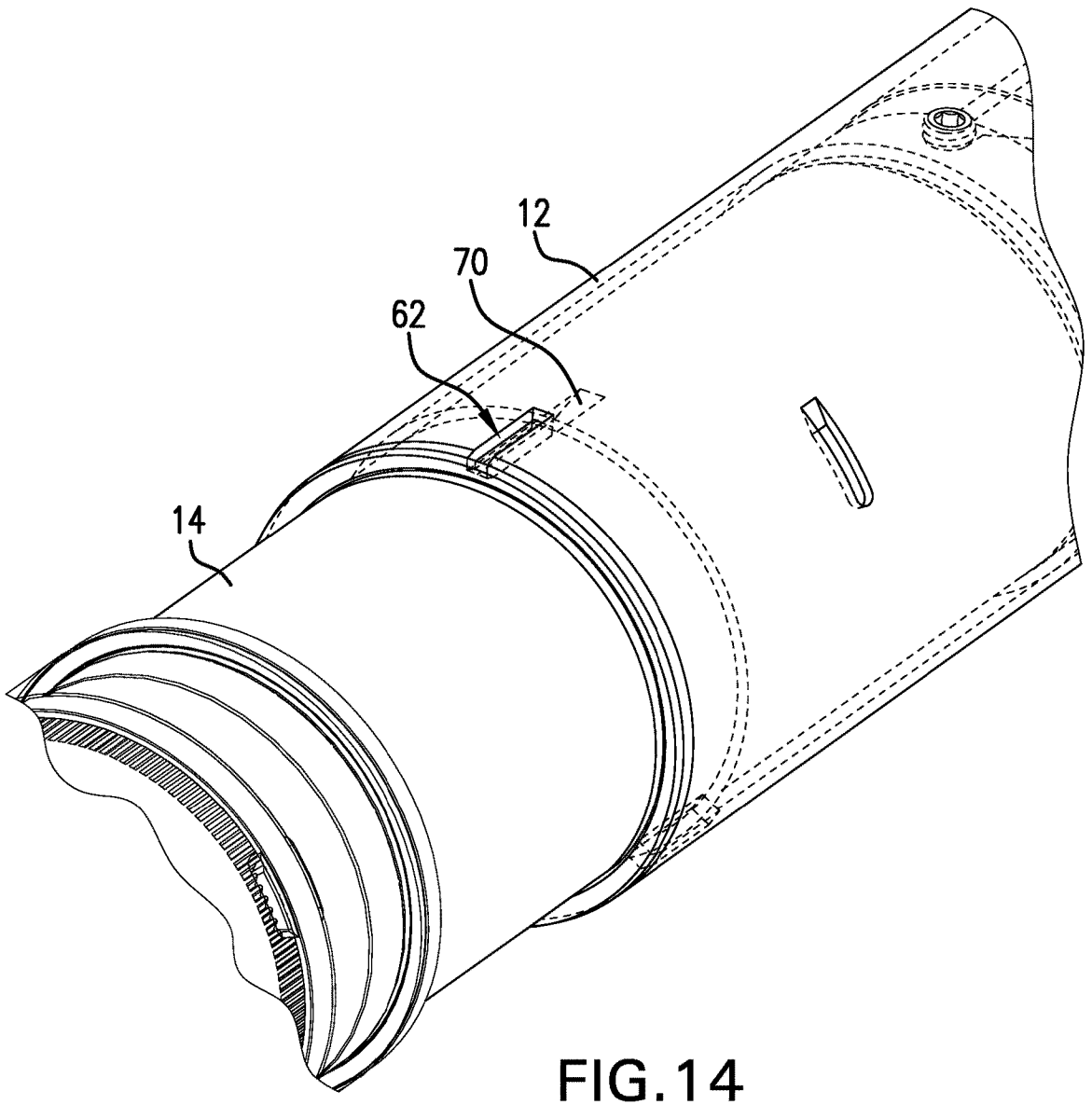
Figure 15:
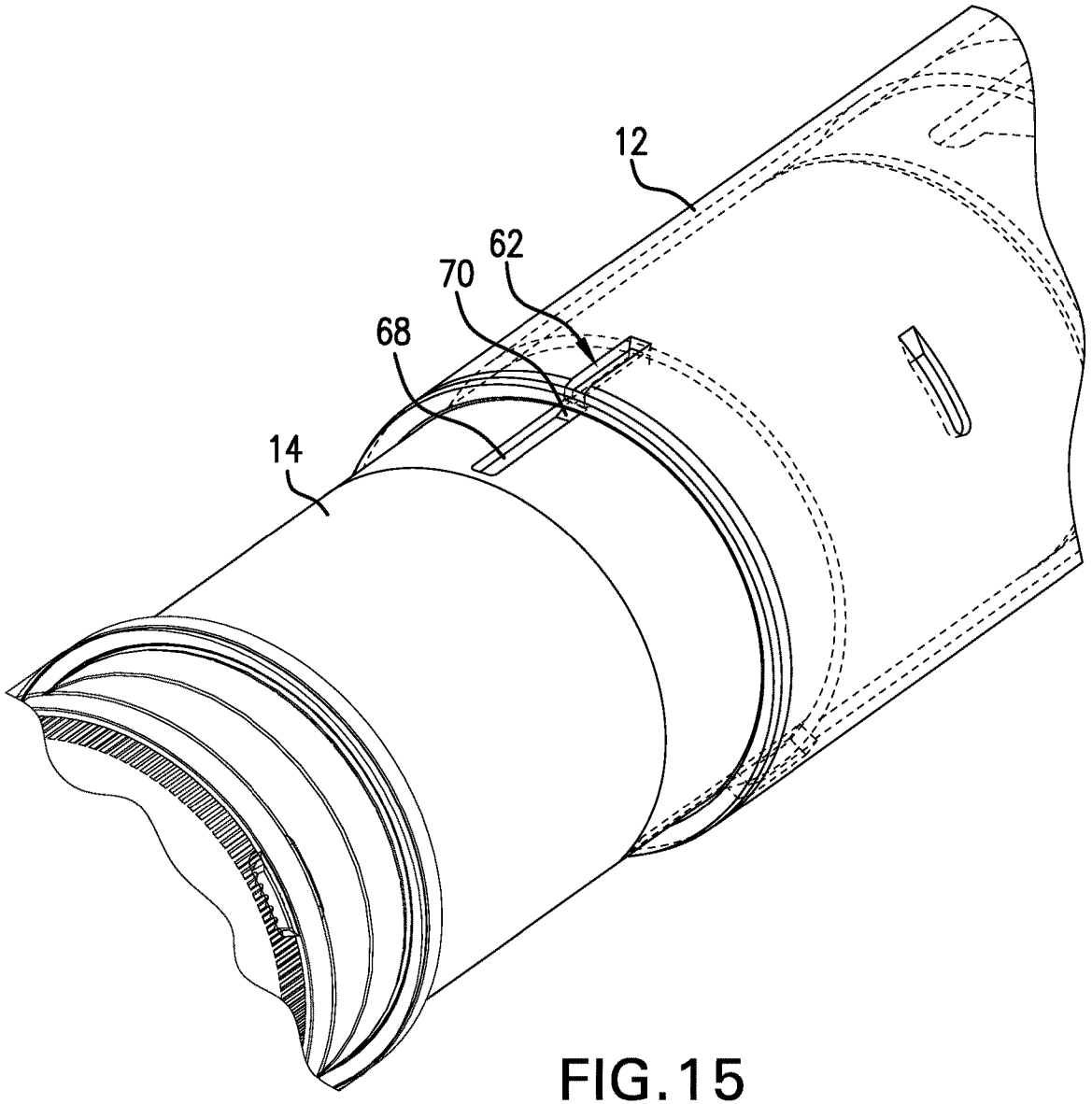
Figure 16:
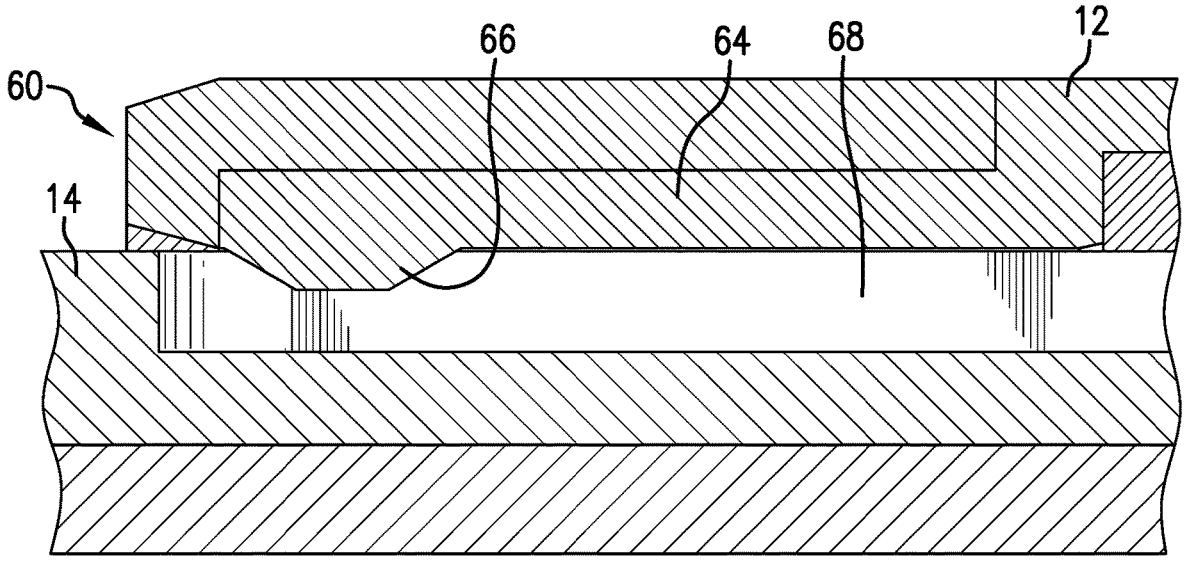
FIG. 16 is an enlarged section view of the detent configuration.

In another embodiment, the assembly 10 includes an additional anti-back-rotation feature 60 that engages and disengages at specific positions of movement of the assembly 10 to prevent and allow rotational movement of the guide nose 12 relative to the body 14. Referring to FIG. 13, guide nose 12 is illustrated with a detent configuration 62, comprising a finger 64 and a profile 66. Also visible is recess 68. When the guide nose 12 is in a position that aligns the detent configuration 62 with the recess 68, the profile 66 of detent configuration 62 engages with recess 68 preventing further relative rotation between the body 14 and the guide nose 12. This position is illustrated in cross section in FIG. 16 where the profile 66 can be seen in the recess 68. Referring to FIGS. 13-15 together, a sequence is illustrated. In FIG. 13, the configuration 62 and recess 68 are not engaged, nor aligned. Upon rotation of guide nose 12 and axial motion thereof that is dictated by the Jslot as described above, the configuration 62 aligns with and engages the recess 68. In this position, it is possible for guide nose 12 to move axially relative to the body 14 but not possible for the guide nose 12 to move rotationally relative to body 14. In this way, it is impossible for the guide nose to rotate in an opposite direction to the direction in which it is supposed to rotate. The issue regarding reverse rotation is discussed in the preceding paragraphs hereof. The recess has a longitudinal length that assures the profile 66 will exit the recess 68 when the guide nose has traveled along nonroational portion 46 and disengages just prior to pin 30 engaging path 48 where rotation in the proper direction is assured. Also in an embodiment, the recess may be provided with ramp 70 (most clearly visible in FIGS. 14-15) to ease the profile 66 out of the recess 68. Once the profile 66 is disengaged with the recess 18, the guide nose 12 is free to rotate relative to the body 14 again (dictated by the Jslot). One or more of the features 60 are contemplated and in an embodiment the number of features 60 will coincide with the number of nonrotational portions 46 of the Jslot.

Figure 17:
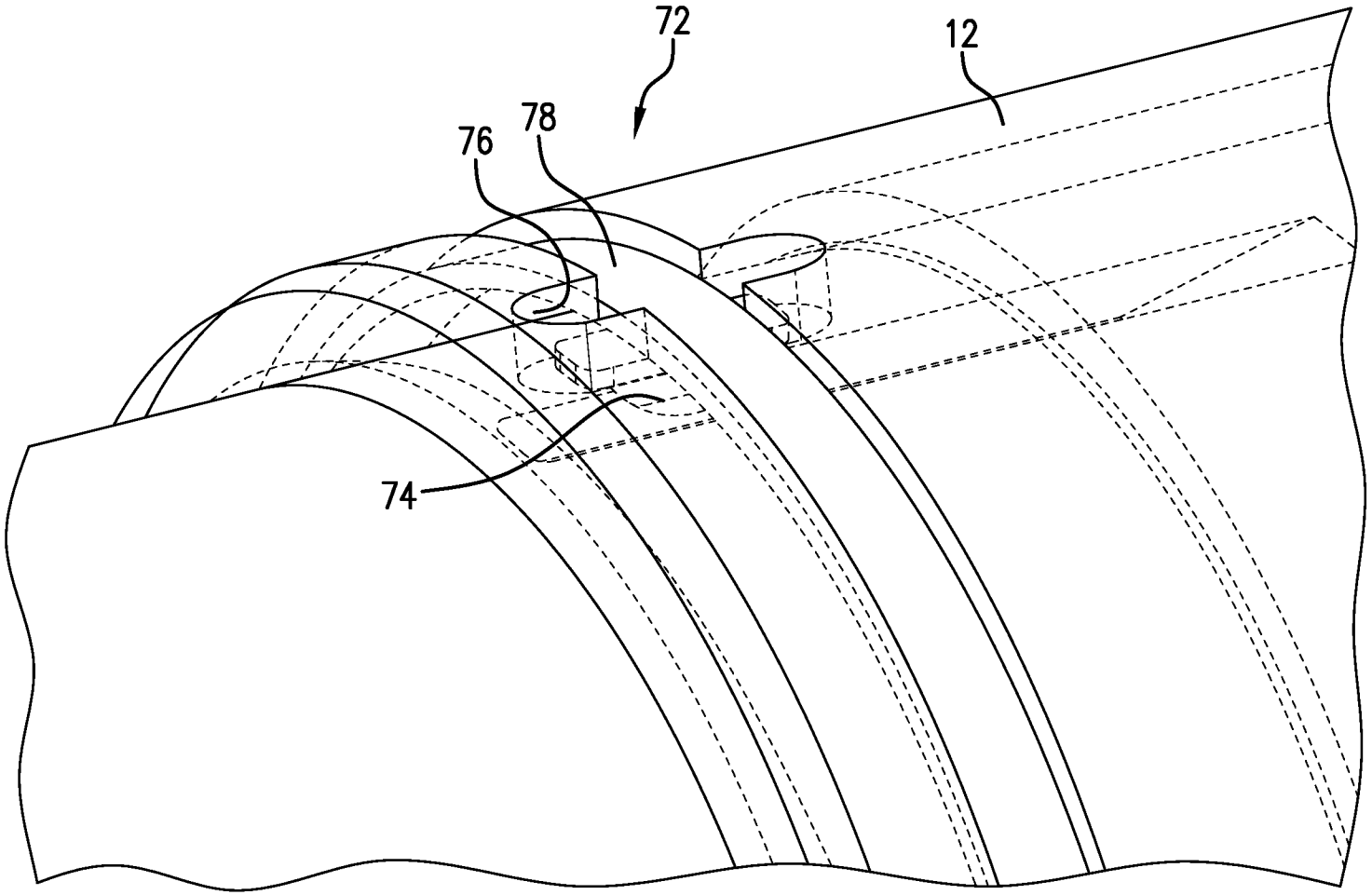
FIG. 17 is a perspective partially transparent view of an alternate anti-back-rotation feature.

An alternate anti-back-rotation feature 72 is illustrated in FIG. 17. In this embodiment a key 74 is positioned through an aperture 76 in guide nose 12 and urged radially inwardly by a C-ring 78. In other respects, the feature 72 works in the same way as the feature 60.

Figure 18:
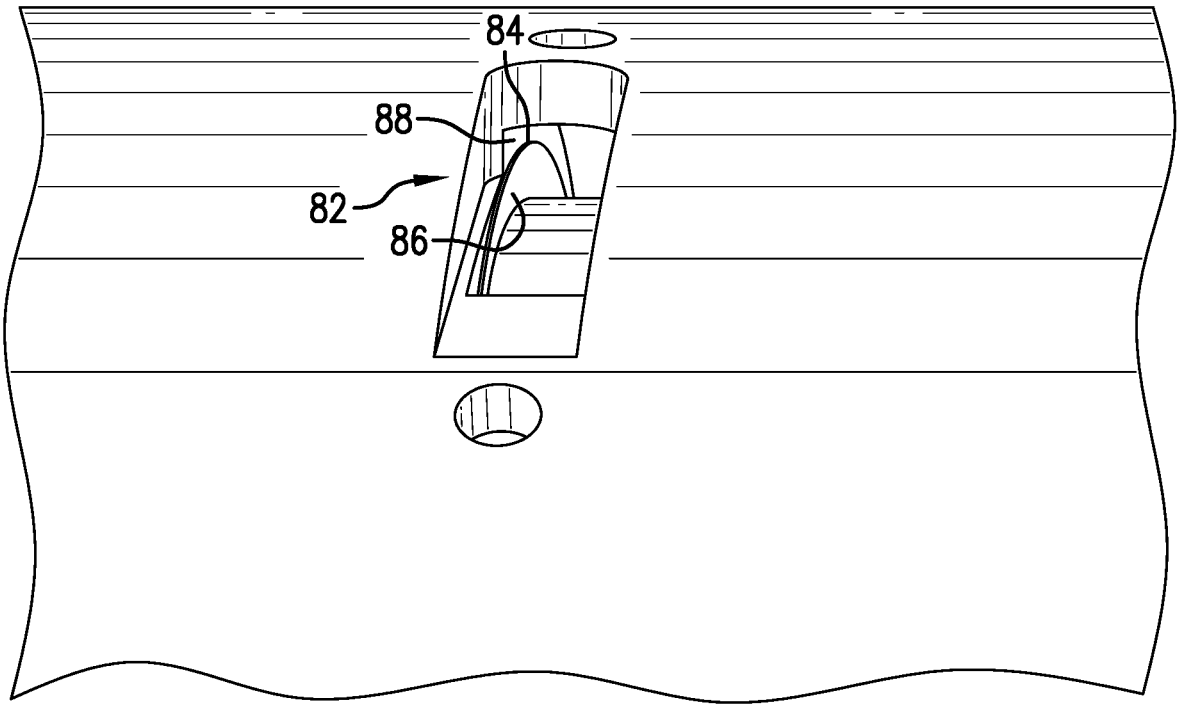
FIGS. 18-22 are views of various embodiments of retention configurations.
Figure 19:
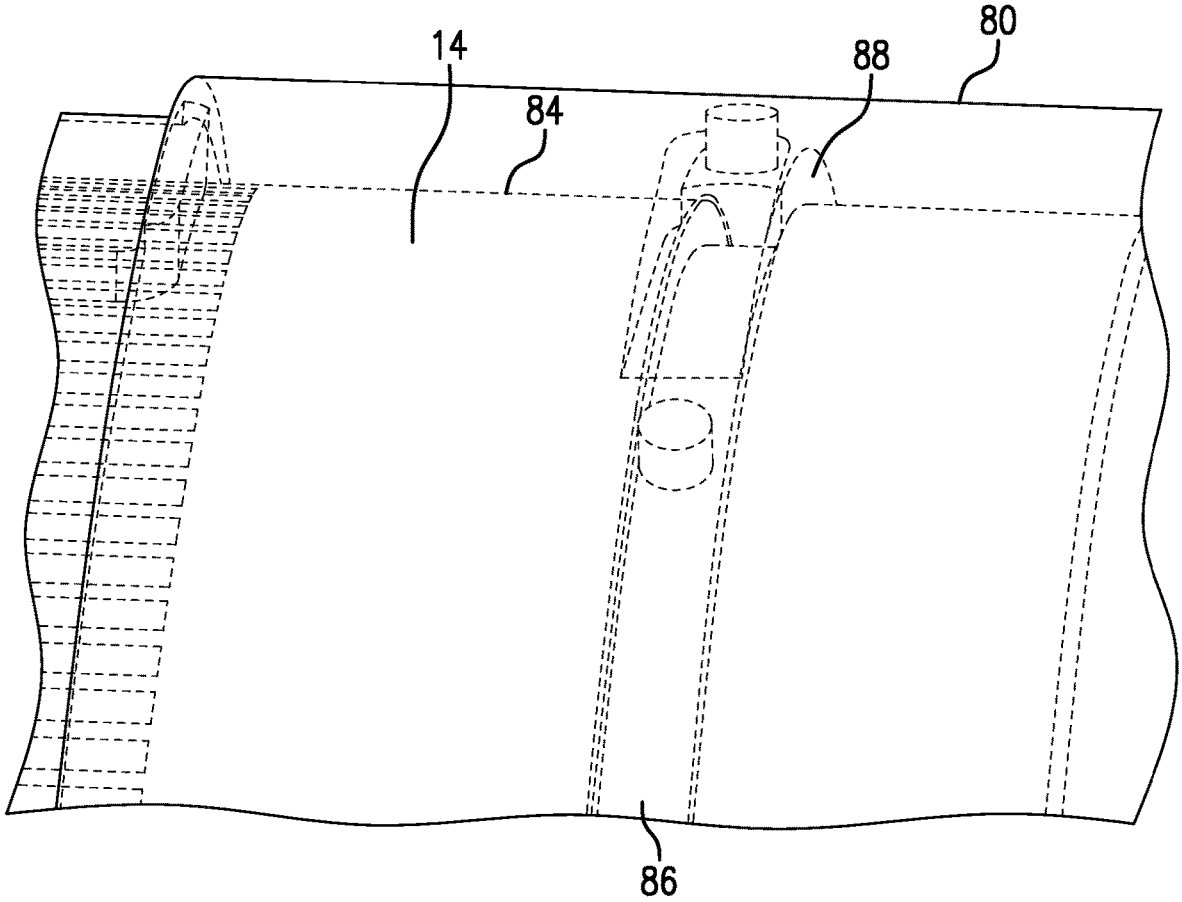

Retention of the body 14 to a string interface 80 is managed with a number of retention arrangement embodiments taught herein. Referring to FIG. 19, a view of an opening 82 in the interface 80 is illustrated. The opening, in an embodiment is created using a square end mill cutting into the interface until the mill causes the opening 82 to extend through the interface 80. The point at which the mill is started is tangent to an outside diameter surface 84 of the body 14. The body 14 includes a groove 86 that is aligned with opening 82 when the tool 10 is assembled. A groove 88 is disposed in the interface 80 on an inside diameter thereof and is also aligned with groove 86 when assembled. Accordingly, there is an annular space about the body 14 that is made up partly of groove 86 and partly of groove 88. This annular space is then filled with a wire having a geometrically similar cross section. In the illustration of FIGS. 18 and 19, where FIG. 18 is opaque and FIG. 19 uses a transparency, one will appreciate the particular geometry is square. A square wire then may be force into the annular space and will lock the interface to the body with regard to axial or longitudinal movement while allowing relative rotation between the interface 80 and body 14.

Figure 20:
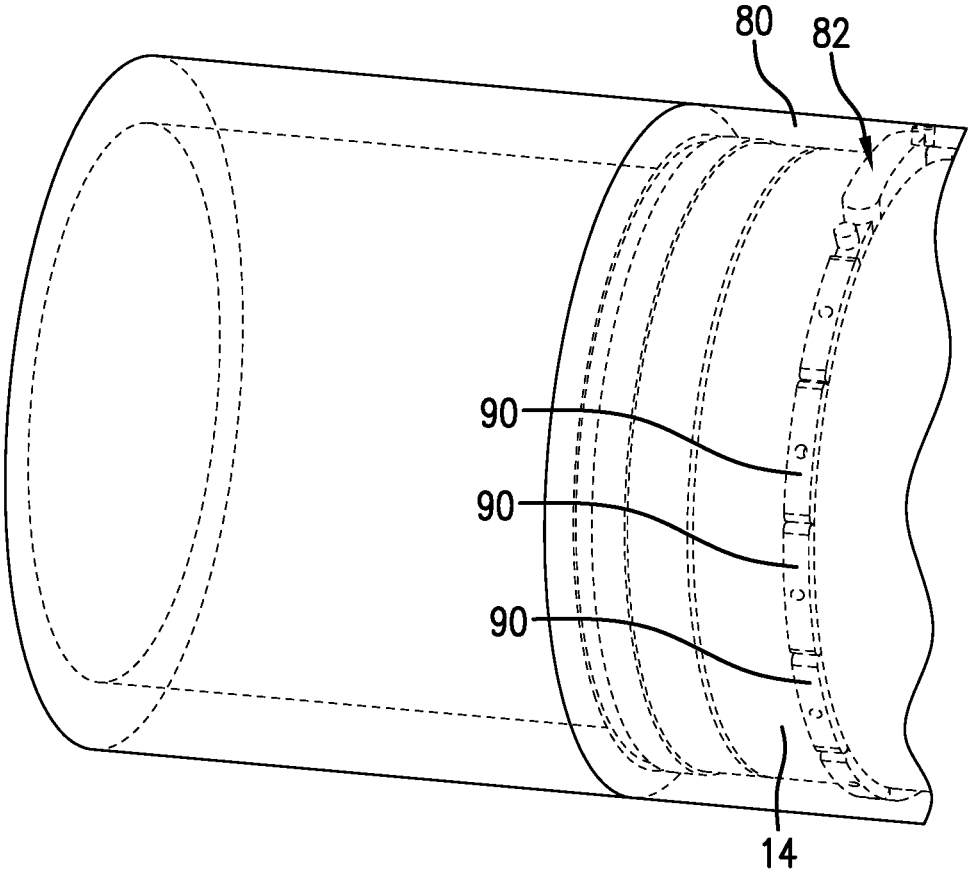

Referring to FIG. 20, instead of the wire, a plurality of inserts 90 are disposed in the same annular space as described in FIGS. 18 and 19 through the same opening 82.

Figure 21:
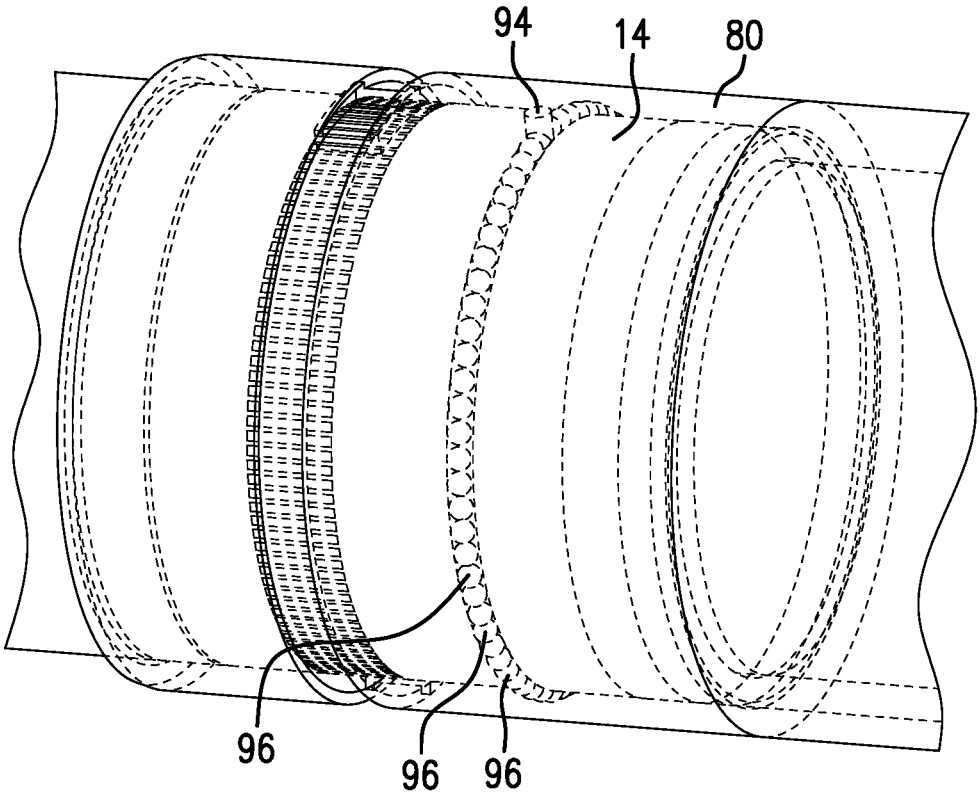
Figure 22:
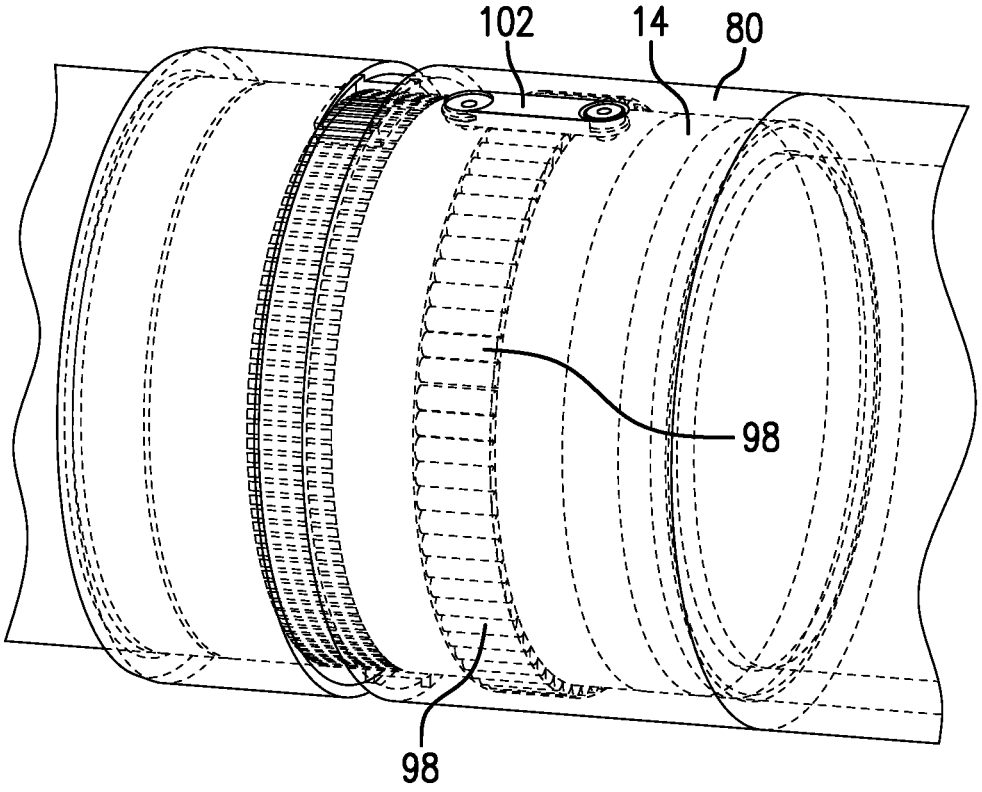

Referring FIG. 21, a more simplified opening 94 is created in the interface 80. The annular space is still created using the same grooves. Ball bearings 96 are disposed in the annular space through the opening 94 to lock the body to the interface longitudinally while still allowing rotations freedom.

In yet another retention configuration for the body 14 to the interface 80, a plurality of cylindrical members 98 are disposed in an annular space similar to that described above in that the annular space comprises a groove in the outside surface 84 of the body 14 and a groove in the inside surface of the interface 80. The cylindrical members 98 are inserted to the annular space through an opening 100, which is then closed with a cover 102.

Figure 23:
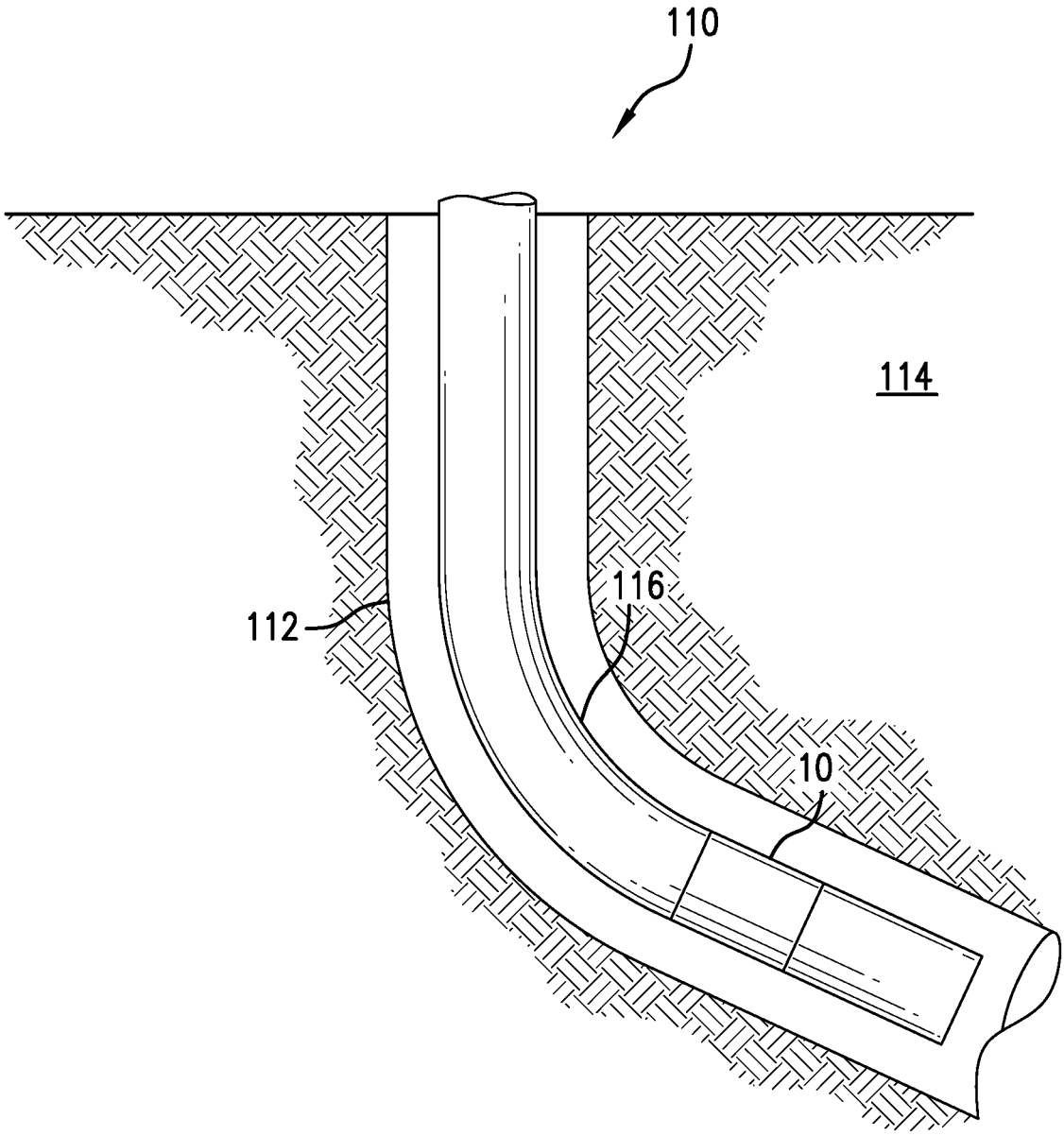
FIG. 23 is a view of a wellbore system including the guide assembly disclosed herein

Referring to FIG. 23, a wellbore system 110. The system 110 comprises a borehole 112 in a subsurface formation 114. A string 116 (same string as referred to above but unnumbered) is disposed in the borehole 112. An assembly 10 as described herein is disposed within or as a part of the string 116.

Set forth below are some embodiments of the foregoing disclosure:

Embodiment 1: A guide assembly including a guide nose, a body supporting the guide nose, and a torque limiter having a configuration to connect the guide nose and the body to a separate structure.

Embodiment 2: The assembly as in any prior embodiment wherein the torque limiter allows relative rotation between the body and the separate structure.

Embodiment 3: The assembly as in any prior embodiment wherein the torque limiter incudes a ratchet and pawl arrangement operably connected to the separate structure.

Embodiment 4: The assembly as in any prior embodiment wherein the pawl is captured in the separate structure with limited radial displacement capability.

Embodiment 5: The assembly as in any prior embodiment wherein the pawl is biased toward the ratchet by a biasing member.

Embodiment 6: The assembly as in any prior embodiment wherein the biasing member is a C-ring.

Embodiment 7: The assembly as in any prior embodiment wherein the guide nose includes an angular portion.

Embodiment 8: The assembly as in any prior embodiment wherein the body includes an incrementing feature configured to rotate the guide nose.

Embodiment 9: The assembly as in any prior embodiment wherein the incrementing feature increments on longitudinal loading and unloading of the guide nose.

Embodiment 10: The assembly as in any prior embodiment wherein the incrementing feature increments the guide nose a number of degrees for each cycle.

Embodiment 11: The assembly as in any prior embodiment wherein the number of degrees of increment is more than a number of degrees of an impediment of a structure past which the assembly is to navigate during use.

Embodiment 12: The assembly as in any prior embodiment wherein the incrementing feature increments about 110 degrees per increment.

Embodiment 13: The assembly as in any prior embodiment wherein the incrementing feature includes a biaser configured to cycle the incrementing feature.

Embodiment 14: The assembly as in any prior embodiment further including a retention arrangement connecting the body to the separate structure so that longitudinal movement between the body and the structure is inhibited while rotational movement between the body and the structure is allowed.

Embodiment 15: The assembly as in any prior embodiment further comprising an anti-back-rotation feature.

Embodiment 16: The assembly as in any prior embodiment wherein the separate structure is a tool string from the surface.

Embodiment 17: A method for negotiating a restriction in a borehole including running a guide assembly as in any prior embodiment into the borehole, encountering a restriction with the guide nose, limiting torque on the guide nose while encountering the restriction, longitudinally unloading the guide nose, incrementing an incrementing feature of the guide assembly to thereby rotate the guide nose.

Embodiment 18: The method as in any prior embodiment wherein the limiting torque is by one way ratcheting.

Embodiment 19: The method as in any prior embodiment wherein the rotating is by a number of degrees that is larger than a number of degrees of an impediment of the restriction.

Embodiment 20: A wellbore system including a borehole in a subsurface formation, a string in the borehole, a guide assembly as in any prior embodiment disposed within or as a part of the string.

Embodiment 21: The wellbore system as in any prior embodiment wherein the guide assembly further includes an incrementing feature.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of +8% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A guide assembly comprising:
a guide nose;
a body supporting the guide nose
an incrementing feature configured to rotate the guide nose, relative to a separate structure, only during unloading of the guide nose; and
a torque limiter having a configuration to connect the guide nose and the body to the separate structure.

2. The assembly as claimed in claim 1 wherein the torque limiter allows relative rotation between the body and the separate structure.

3. The assembly as claimed in claim 1 wherein the torque limiter incudes a ratchet and pawl arrangement operably connected to the separate structure.

4. The assembly as claimed in claim 3 wherein the pawl is captured in the separate structure with limited radial displacement capability.

5. The assembly as claimed in claim 4 wherein the biasing member is a C-ring.

6. The assembly as claimed in claim 3 wherein the pawl is biased toward the ratchet by a biasing member.

7. The assembly as claimed in claim 3 further including a retention arrangement connecting the body to the separate structure so that longitudinal movement between the body and the structure is inhibited while rotational movement between the body and the structure is allowed.

8. The assembly as claimed in claim 1 wherein the guide nose includes an angular portion.

9. The assembly as claimed in claim 1 wherein the incrementing feature increments the guide nose a number of degrees per increment.

10. The assembly as claimed in claim 9 wherein the incrementing feature increments about 110 degrees per increment.

11. The assembly as claimed in claim 1 wherein the incrementing feature includes a biaser configured to cycle the incrementing feature.

12. The assembly as claimed in claim 1 further comprising an anti-back-rotation feature.

13. The assembly as claimed in claim 1 wherein the separate structure is a tool string from the surface.

14. A method for negotiating a restriction in a borehole comprising:
running a guide assembly as claimed in claim 1 into the borehole;
encountering a restriction with the guide nose;
limiting torque on the guide nose while encountering the restriction;
longitudinally unloading the guide nose;
incrementing the incrementing feature of the guide assembly to thereby rotate the guide nose.

15. The method as claimed in claim 14 wherein the limiting torque is by one way ratcheting.

16. The method as claimed in claim 14 wherein the rotating is by a number of degrees that is larger than a number of degrees of an impediment of the restriction.

17. A wellbore system comprising:
a borehole in a subsurface formation;
a string in the borehole;
a guide assembly as claimed in claim 1 disposed within or as a part of the string.

* * * * *